US006572414B2

(12) United States Patent
Ahn et al.

(10) Patent No.: US 6,572,414 B2
(45) Date of Patent: Jun. 3, 2003

(54) MODULAR JACK FOR LOW CROSSTALK ELECTRICAL CONNECTOR

(75) Inventors: Jeong-Gyun Ahn, Gyeonggi-do (KR); Taeseok Suh, Gyeonggi-do (KR); Sangjo Kim, Gyeonggi-do (KR); Junggon Kim, Gyeonggi-do (KR); Sung Hyuk Joo, Gyeonggi-do (KR); Byoung-Wook Kang, Gyeongsangbuk-do (KR); Noh-Hoon Myung, Daejeon (KR); Jung-Ho Yoon, Daejeon (KR)

(73) Assignees: Korea Telecom (KR); The Institute of Information Technology Assessment (KR)

( * ) Notice: Subject to any disclaimer, the term of this patent is extended or adjusted under 35 U.S.C. 154(b) by 0 days.

(21) Appl. No.: 10/024,198

(22) Filed: Dec. 21, 2001

(65) Prior Publication Data

US 2002/0081908 A1 Jun. 27, 2002

(30) Foreign Application Priority Data

Dec. 27, 2000 (KR) ..... 2000-82870
Mar. 28, 2001 (KR) ..... 2001-16166

(51) Int. Cl.[7] ..... H01R 23/02

(52) U.S. Cl. ..... 439/676; 439/941

(58) Field of Search ..... 439/941, 676

(56) References Cited

U.S. PATENT DOCUMENTS 5,941,734 A * 8/1999 Ikeda et al. ..... 439/676
5,971,813 A * 10/1999 Kunz et al. ..... 439/676
6,019,641 A * 2/2000 Kan ..... 439/676
6,102,730 A * 8/2000 Kjeldahi et al. ..... 439/676
6,383,029 B1 * 5/2002 Bolouri-Saransar ..... 439/676

* cited by examiner

*Primary Examiner*—Tho D. Ta
(74) *Attorney, Agent, or Firm*—Pennie & Edmonds LLP

(57) ABSTRACT

A modular jack includes a housing, a first signal pair, and a second signal pair. The first signal pair passes through the housing and includes a first conductor and a second conductor. A first imaginary plane contains the first and the second conductor. The second signal pair passes through the housing and includes a third conductor and a fourth conductor. A second imaginary plane contains the third and the fourth conductor, which are bent at least one time to cross each other inside the housing. The first and the second imaginary plane form a first angle of 80 to 90 degrees inside the housing before the crossing of the third and the fourth conductor while they form a second angle of 0 to 10 degrees inside the housing after the crossing thereof.

14 Claims, 16 Drawing Sheets

MODULAR JACK FOR LOW CROSSTALK ELECTRICAL CONNECTOR

FIELD OF THE INVENTION

The present invention relates to an electrical connector; and, more particularly, to a modular jack of an electrical connector implementing a low crosstalk.

BACKGROUND OF THE INVENTION

A communications terminal used in an office or home is electrically connected to an outdoor transmission cable via an electrical connector, which usually includes a modular jack and a plug. Though a four-pin connector has been widely used for the communications terminal, an eight-pin connector is now being developed to satisfy the need for a high transmission speed. Telecommunication Industry Association (TIA) and Electronic Industry Association (EIA) of U.S. are specifying Category 6, a new industrial specification, to keep up with a rapid development of communication parts including the eight-pin connector.

In a transmission cable, each pair of lines forms a signal pair to transmit a specific electrical signal. If a signal pair transmitting a first signal is adjacent to another pair transmitting a second signal, a capacitive coupling and an inductive coupling are induced between the first and the second signal, thereby causing an error in the signals. Such an electromagnetic interference between two adjacent signals is referred to as a crosstalk.

As shown in FIG. 1, an insert 2 of a conventional eight pin modular jack (not shown) includes an insert housing 4 and eight insert conductors "R1" to "R4" and "T1" to "T4". The insert conductors "R1" to "R4" and "T1" to "T4" are arranged to run parallel to each other on one plane while maintaining a constant pitch therebetween. Portions of the insert conductors are embedded in the insert housing 4 serving to maintain relative positions thereof.

Such a single level arrangement of the insert conductors causes significant crosstalks both inside and outside the insert housing 4. Therefore, an electrical connector adopting the conventional modular jack can hardly satisfy specifications of Category 6.

In FIG. 2, there is illustrated a schematic arrangement of the conventional insert conductors "R1" to "R4" and "T1" to "T4" in order to explain the crosstalks therebetween, herein only a few capacitive coupling components are depicted for the sake of simplicity.

In the drawing, a first conductor "R1" and a second conductor "T1" form a first signal pair to transmit a first signal; a fourth conductor "T2" and a fifth conductor "R2" form a second signal pair for a second signal; a third conductor "R3" and a sixth conductor "T3" form a third signal pair for a third signal; and a seventh conductor "R4" and an eighth conductor "T4" form a fourth signal pair for a fourth signal. The second conductor "T1" and the third conductor "R3" are adjacent to each other and transmit different signals, i.e., the first signal and the third signal, respectively. Therefore, a strong electromagnetic coupling is induced between the first signal of the second conductor "T1" and the third signal of the third conductor In other words, a first capacitance "C13" is induced between the first conductor "R1" and the third conductor "R3" while a second capacitance "C23" is induced between the second conductor "T1" and the third conductor "R3". The second capacitance "C23" is larger than the first capacitance "C13" (C23>C13), because the capacitance is inversely proportional to a distance between two conductors and the third conductor "R3" is closer to the second conductor "T1" than the first conductor "R1" is. The above-explained capacitance difference causes an electrical potential difference between the second conductor "T1" and the third conductor "R3", thereby increasing the capacitive coupling of the first signal of the second conductor "T1" and the third signal of the third conductor "R3".

Further, a third capacitance C16 is induced between the first and sixth conductor "R1" and "T3". However, because the sixth conductor "T3" is located relatively very far away from the first conductor "R1", the third capacitance C16 is very small and an effect thereof can be disregarded.

Like the second and the third conductor "T1" and "R3", if two conductors are respectively involved with different signal pairs but electromagnetically coupled, they are referred to as a crosstalk pair. The crosstalk mainly occurs between the conductors of the crosstalk pairs, such as "T1–R3", "R3–T2", "R2–T3", and "T3–R4".

Though the previous explanation is focused on the first to the third capacitances "C13", "C23" and "C16", other capacitances including a fourth to a sixth capacitances "C12", "C36" and "C26" are also induced among the insert conductors. A detailed explanation about the fourth to the sixth capacitances, however, is omitted for the sake of simplicity.

The U.S. Pat. No. 5,299,956 teaches a method for preventing the crosstalk. In the method in accordance with the above-mentioned U.S. patent, an opposite electromagnetic coupling is induced to cancel the inductive or capacitive coupling. With reference to FIG. 3, the purport of the U.S. Pat. No. 5,299,956 will be explained.

As shown, a first signal pair "S1" includes a first tip conductor "T1" and a first ring conductor "R1" while a second signal pair "S2" includes a second tip conductor "T2" and a second ring conductor "R2". In a first portion "Z1", the second tip conductor "T2" and the second ring conductor "R2" are disposed adjacent to the first ring conductor "R1" and the first tip conductor "T1", respectively. In a second portion "Z2", however, positions of the second tip and the second ring conductor "T2" and "R2" are interchanged with each other, such that the second ring conductor "R2" and the second tip conductor "T2" are disposed adjacent to the first ring conductor "R1" and the first tip conductor "T1", respectively.

In the above-described configuration, a first crosstalk occurs between the first and the second signal pair "S1" and "S2" in the first portion "Z1" while a second crosstalk occurs therebetween in the second portion "Z2". Because of the above-mentioned interchange of positions in the second portion "Z2", the first crosstalk and the second crosstalk have opposite phases, thereby canceling each other.

That is to say, first inductive and the first capacitive coupling induced in the first portion "Z1", and second inductive and second capacitive couplings induced in the second portion "Z2" have phases opposite to each other. Accordingly, the first inductive and the first capacitive coupling are canceled by the second inductive and the second capacitive coupling, such that a total crosstalk is reduced.

The method in accordance with the prior art can provide a simple configuration for a low crosstalk electrical connector by way of simultaneously canceling each of the capacitive coupling and the inductive coupling in the same portion. For the same reason, however, at least one of the capacitive coupling and the inductive coupling cannot be wholly canceled and a considerable amount of the crosstalk still remains.

The crosstalk cannot be actually reduced below a level of −46 dB even if the above-explained method is employed, if the transmission frequency of signal is around 250 MHz. That is to say, though a higher transmission frequency is required as the data transmission speed increases, the method in accordance with the prior art can rarely satisfy newly required specifications.

SUMMARY OF THE INVENTION

It is, therefore, an object of the present invention to provide a modular jack for an electrical connector that implements a low crosstalk for transmitting high frequency signals.

In accordance with one aspect of the invention, a preferred embodiment of the present invention provides a modular jack for a low crosstalk electrical connector, the jack including: a housing; a first signal pair passing through the housing and including a first conductor and a second conductor, a first imaginary plane containing the first and the second conductor; and a second signal pair passing through the housing and including a third conductor and a fourth conductor, a second imaginary plane containing the third and the fourth conductor, which are bent at least once to cross each other inside the housing, wherein the first and the second imaginary plane form a first angle of 80 to 90 degrees inside the housing before the crossing of the third and the fourth conductor while the first and the second imaginary plane form a second angle of 0 to 10 degrees inside the housing after the crossing thereof.

Another preferred embodiment of the present invention provides an insert of a crosstalk reducing modular jack, the insert including: an upper housing; a lower housing joined with the upper housing, the upper and the lower housing being symmetrical to each other with respect to a contact surface therebetween; an upper set including a first to a fourth tip conductor passing through the upper housing and being arranged on a plurality of levels, the third tip conductor having a first and a second protrusion protruded toward the second and the fourth tip conductor, respectively; and a lower set positioned under the upper set, the lower set including a first to a fourth ring conductor passing through the lower housing and being arranged on a plurality of another levels, the second ring conductor having another first and another second protrusion protruded toward the first and third ring conductor, respectively; a first air space interposed between the upper and the lower set; a second air space surrounding a portion of the first tip conductor inside the upper housing; and a third air space surrounding a portion of the fourth ring conductor inside the lower housing.

In accordance with another aspect of the invention, another preferred embodiment of the present invention provides a low crosstalk connector including: a first portion where an inductive coupling and a capacitive coupling are induced between adjacent lines, each independently transmitting a signal; a second portion where capacitances induced between the adjacent lines are selectively compensated to reduce the capacitive coupling; and a third portion where an opposite inductive coupling is induced between the adjacent lines to cancel the inductive coupling, wherein the inductive coupling of the second portion is minimized while the opposite inductive coupling of the third portion is maximized.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
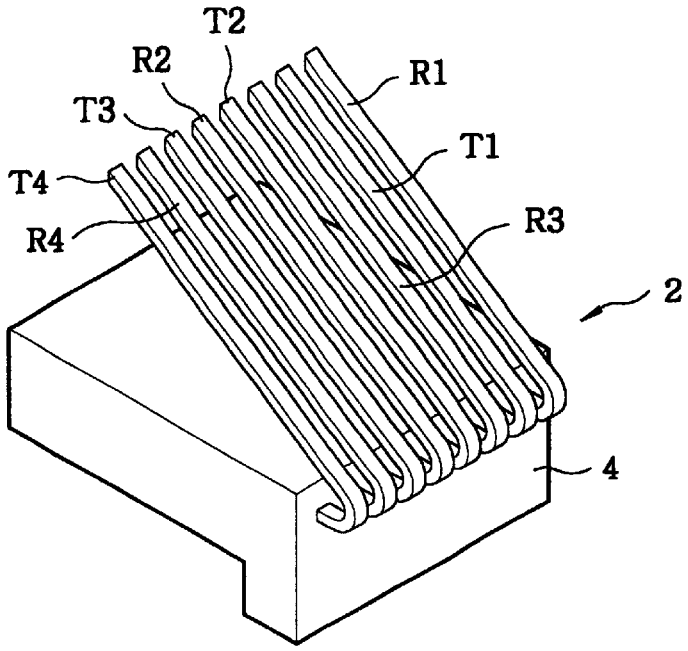
FIG. 1 (PRIOR ART)
FIG. 1 is a perspective view showing an insert of a modular jack of an electrical connector in accordance with a prior art.
Figure 2:
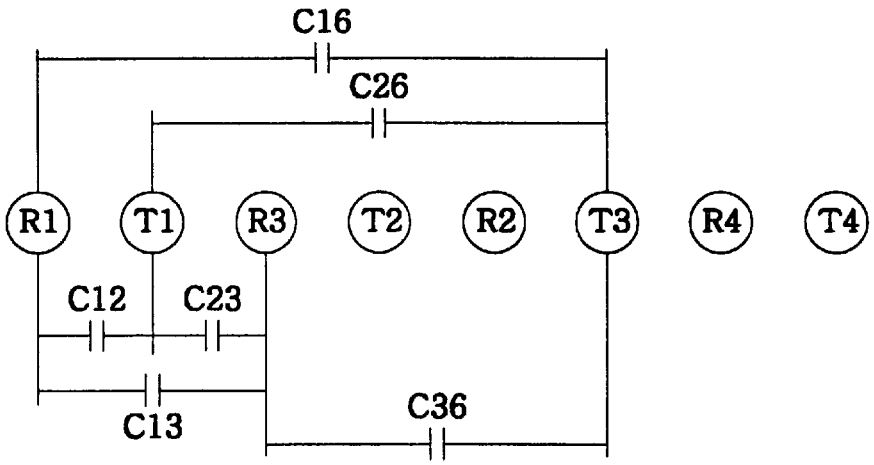
FIG. 2 (PRIOR ART)
FIG. 2 is a cross-sectional view illustrating a single level arrangement of conductors of the insert shown in FIG. 1.
Figure 3:
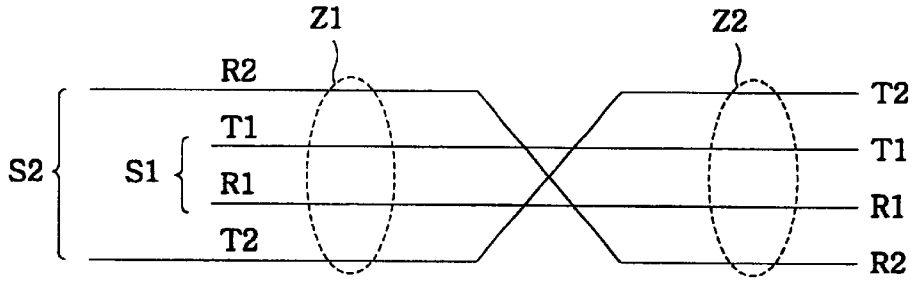
FIG. 3 (PRIOR ART)
FIG. 3 is a conceptual circuit diagram illustrating a conventional method for reducing a crosstalk.

Referring now to FIGS. 4 to 22, preferred embodiments of the present invention will be explained in detail. Like reference numerals represent like parts in FIGS. 4 to 22.

Figure 4:
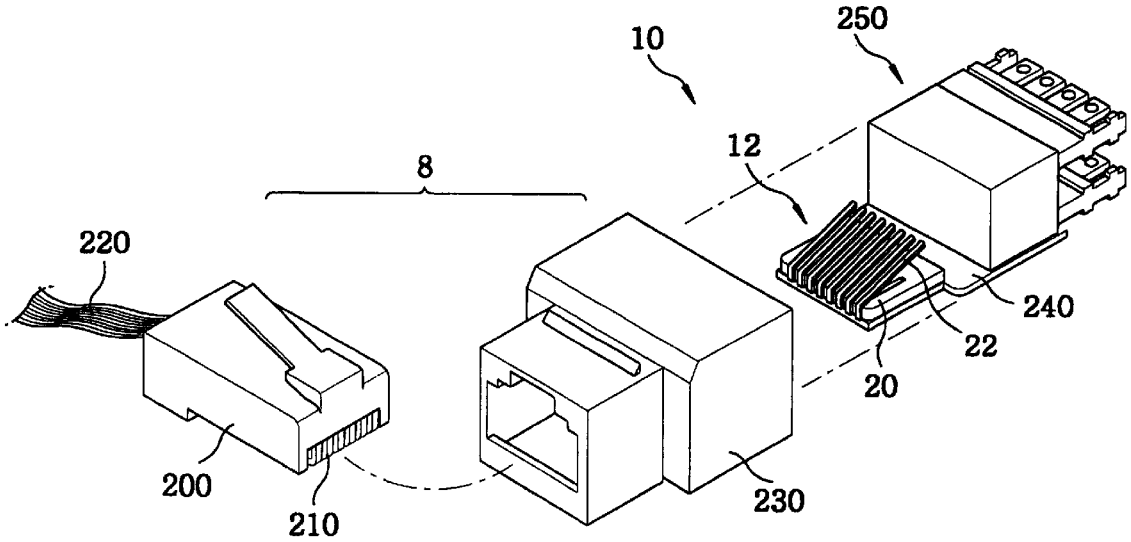
FIG. 4 is a disassembled perspective view illustrating an electrical connector in accordance with the present invention.

In FIG. 4, an electrical connector 8 in accordance with preferred embodiments of the present invention includes a modular jack 10 and a plug 200. The modular jack 10 and the plug 200 are electrically connected with an outdoor cable (not shown) and a terminal cable 220, respectively. The plug 200 has a plurality of guide grooves 210. The modular jack 10 includes a case 230, a printed circuit board (PCB) 240, an insert 12, and a connecting portion 250. Further, the insert 12 has an insert housing 20 and a plurality of insert conductors 22 fixed by the insert housing 20.

The insert 12 and the connection portion 250 are mounted on a surface of the PCB 240 and contained in the case 230. The PCB 240 contains a plurality of electrical lines (not shown), which electrically connect the plurality of the insert conductors 22 with the connecting portion 250. The case 230, the insert 12, the PCB 240, and the connecting portion 250 are assembled together so as to form the modular jack 10.

Figure 5:
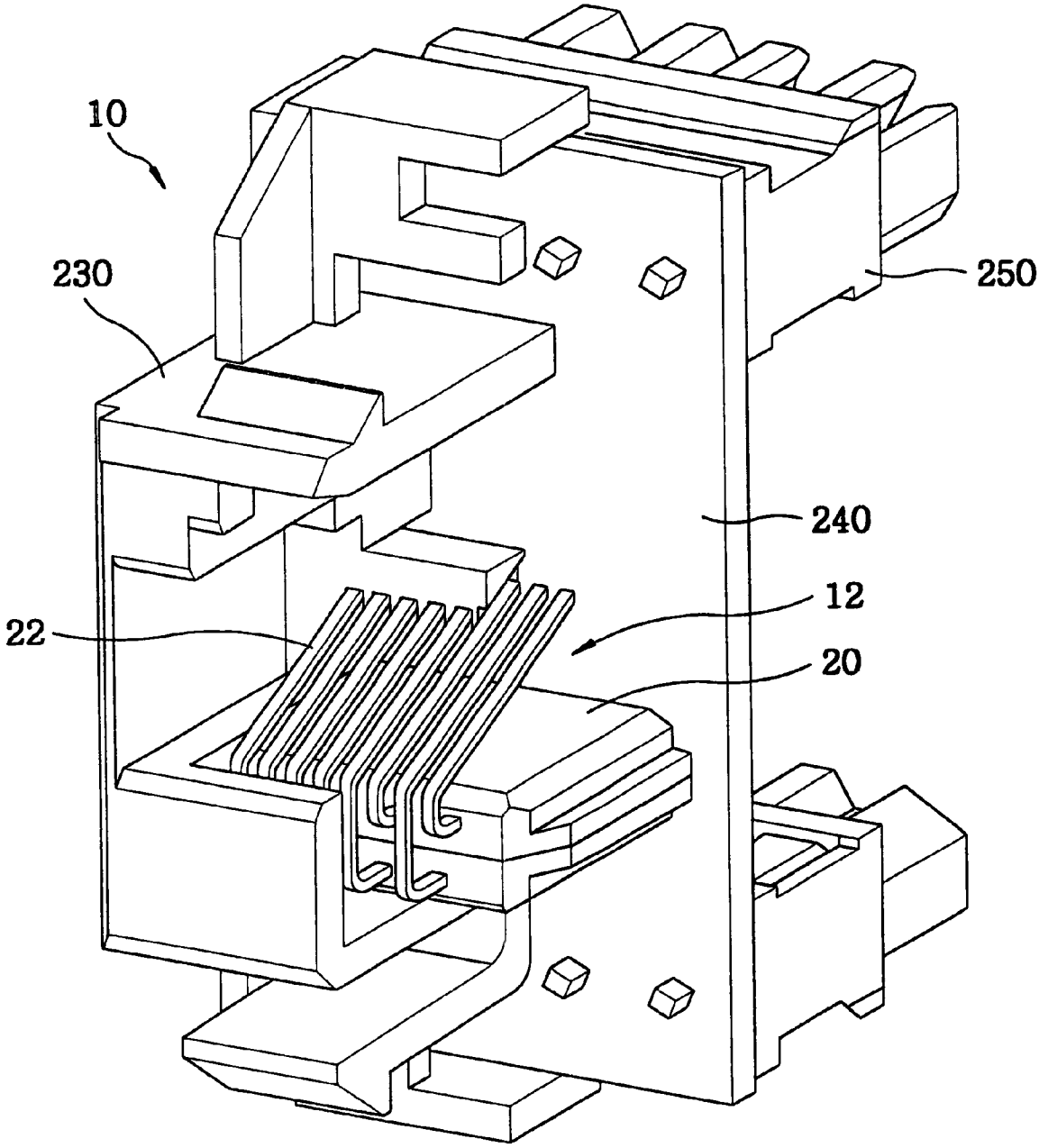
FIG. 5 is a partial sectional perspective view showing a modular jack of the electrical connector shown in FIG. 4.

FIG. 5 shows a modification of the modular jack 10 shown in FIG. 4. As shown, the insert 12 and the connecting portion 250 are mounted on a front surface and a rear surface of the PCB 240, respectively, and the case 230 contains the insert 12 and the PCB 240. The insert housing 20 is made of a synthetic resin and the insert conductors 22 pass through the insert housing 20. Inside the insert housing 20, the plurality of the insert conductors 22 have a multi-level arrangement where at least one insert conductor 22 is arranged on a different level. A double level arrangement of FIG. 5 is an example of the multi-level arrangement.

Figure 6:
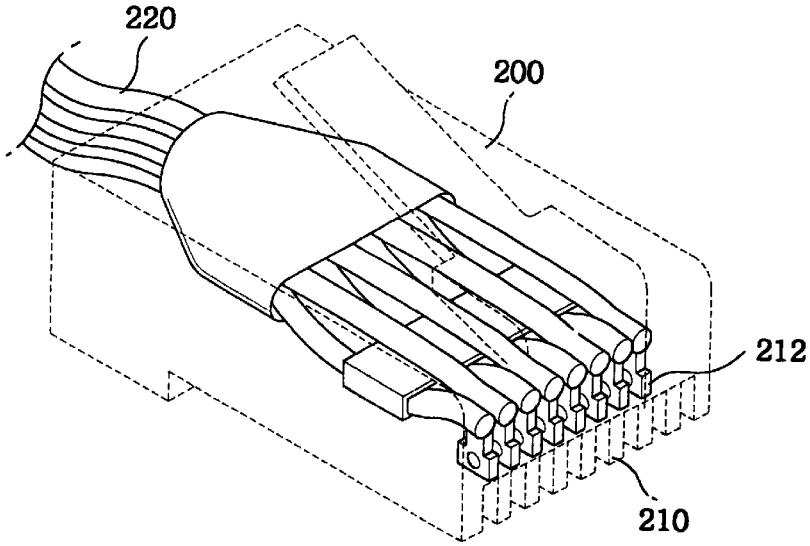
FIG. 6 is a perspective view showing a plug of the electrical connector shown in FIG. 4.

Outside the insert housing 20, a first end and a second end of each insert conductor 22 are protruded from a front surface and a rear surface of the insert housing 20, respectively. The first end of each insert conductor 22 is bent upward with respect to the insert housing 20. When the plug 200 (FIG. 4) and the modular jack 10 are connected together, the first end of each insert conductor 22 makes an electrical contact with a corresponding plug conductor 212 (FIG. 6) of the plug 200 (FIG. 6). On the other hand, the second end of each insert conductor 22 is electrically connected with the PCB 240.

In FIG. 6, the plug 200 includes a plurality of plug conductors 212. Each of the plug conductors 212 makes an electric contact with a corresponding insert conductor 22 (FIG. 5) when each insert conductor is introduced into a corresponding guide groove 210 of the plug 200. That is to say, returning to FIG. 4, if the plug 200 is inserted into the case 230 of the modular jack 10, each plug conductor 212 makes an electric contact with a corresponding insert conductor 22, such that the plug 200 and the modular jack 10 are electrically connected.

Figure 7:
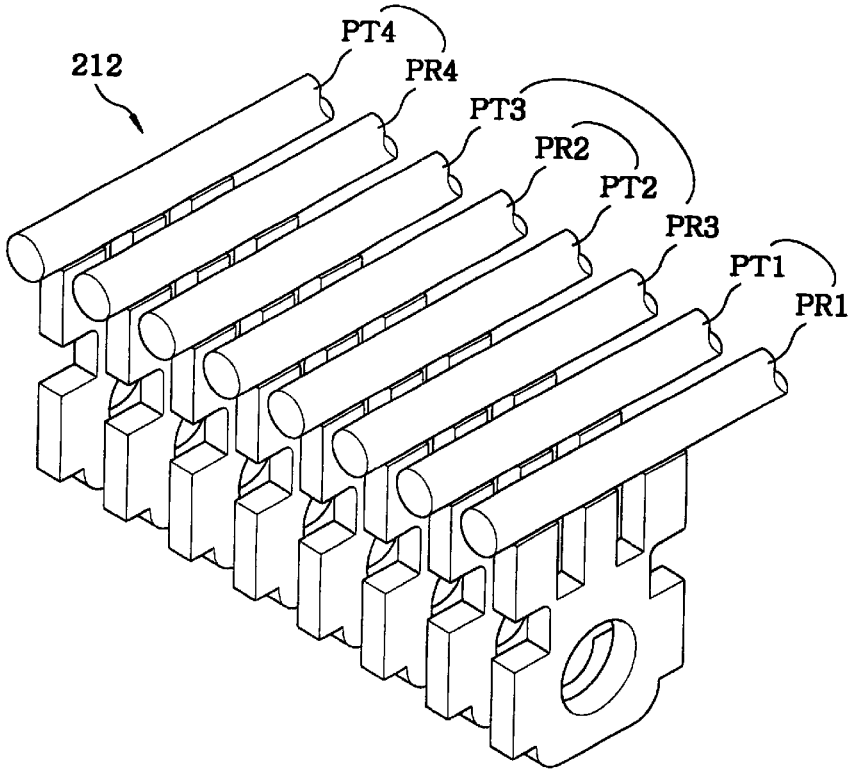
FIG. 7 is an expanded perspective view showing an arrangement of plug conductors of the plug shown in FIG. 6.

FIG. 7 shows the plug conductors 212 of the plug 200 (FIG. 6) in an expanded view. A first plug conductor "PR1" and a second plug conductor "PT1" form a first signal pair for transmitting a first signal; a fourth plug conductor "PT2" and a fifth plug conductor "PR2" form a second signal pair for a second signal; a third plug conductor "PR3" and a sixth plug conductor "PT3" form a third signal pair for a third signal; and a seventh plug conductor "PR4" and an eighth plug conductor "PT4" form a fourth signal pair for a fourth signal.

The second plug conductor "PT1" and the third plug conductor "PR3" are adjacent to each other and transmit different signals after contacting corresponding insert conductors. Therefore, the second plug conductor "PT1" and the third plug conductor "PR3" form a crosstalk pair "PT1–PR3" where a crosstalk occurs. For the same reason, each of pairs "PR3–PT2", "PR2–PT3", and "PT3–PR4" forms a crosstalk pair.

Hereinafter, there will be described an insert 12 in accordance with a first preferred embodiment of the present invention. The insert 12 is capable of removing or significantly reducing the crosstalk, by way of adopting capacitance compensation and the double level arrangement.

Figure 8:
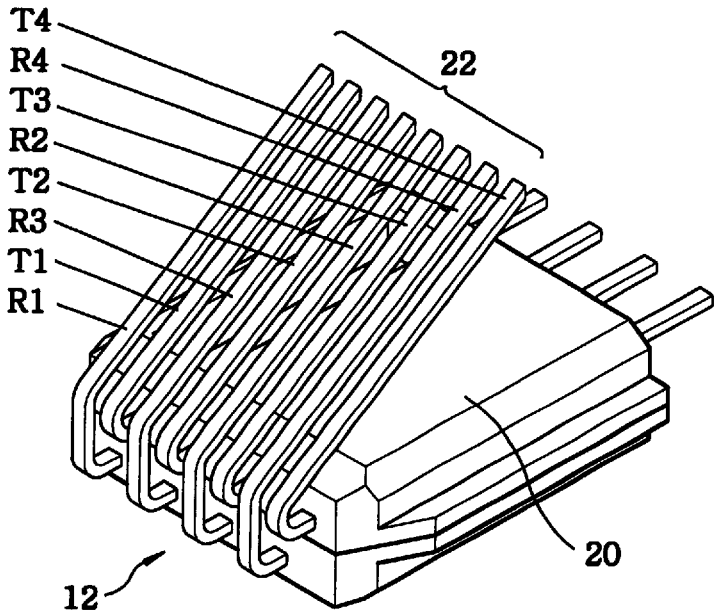
FIG. 8 is a perspective view showing the insert in accordance with a first preferred embodiment of the present invention.
Figure 9:
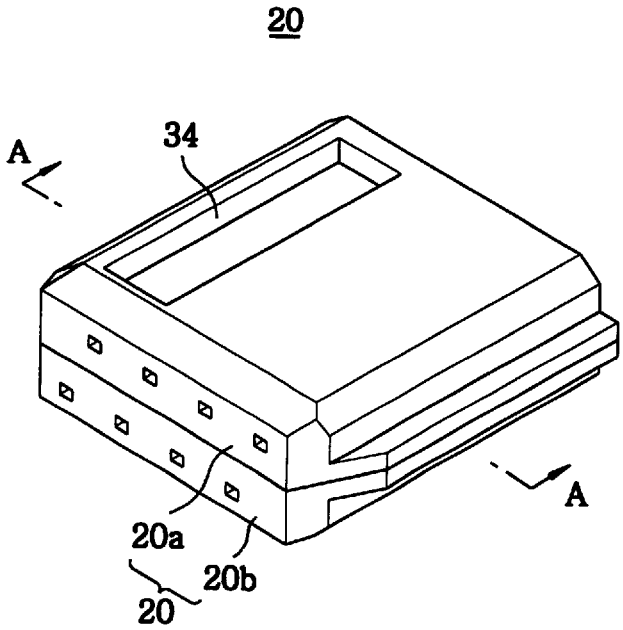
FIG. 9 is a perspective view showing only an upper and a lower insert housing of FIG. 8.

In FIG. 8, the insert 12 in accordance with the first preferred embodiment of the present invention includes the insert housing 20 and the plurality of the insert conductors 22. The plurality of the insert conductors 22 have a first to a fourth tip conductors "T1" to "T4" positioned on an upper level and a first to a fourth ring conductors "R1" to "R4" positioned on a lower level. The insert housing 20 has an upper insert housing 20*a* and a lower insert housing 20*b*, as shown in FIG. 9. The insert conductors 22 are not illustrated in FIG. 9 for the sake of convenience.

Figure 10A:
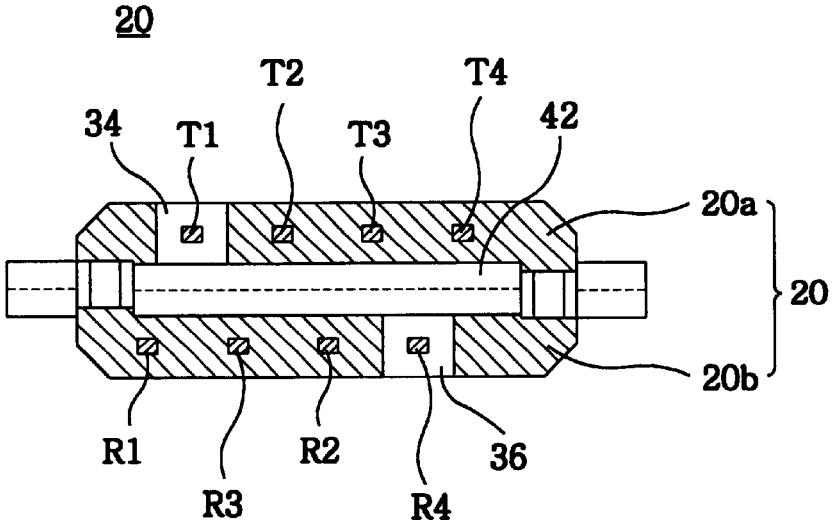
FIGS. 10A and 10B are sectional views taken along a line "A–A" of FIG. 9, respectively.

FIG. 10A is a cross-sectional view taken along a line "A–A" of FIG. 9, wherein it is assumed that the tip conductors "T1" to "T4" and the ring conductors "R1" to "R4" are present and are assembled with the insert housing 20.

The upper and the lower insert housing 20*a* and 20*b* include an upper and a lower opening portion 34 and 36, respectively, and are joined together so as to form the insert housing 20. The upper and the lower opening portion 34 and 36 expose portions of the first tip conductor "T1" and the fourth ring conductor "R4", respectively, such that the portions of the first tip conductor "T" and the fourth ring conductor "R4" are surrounded by air. Because the air has a much lower dielectric constant than the upper insert housing 22*a* or lower insert housing 22*b* has, capacitances induced in relation with the first tip conductor "T1" or the fourth ring conductor "R4" are relatively much smaller.

Further, the insert housing 20 formed by joining the upper and the lower insert housing 20*a* and 20*b* includes an air space 42, which is formed between the upper and the lower insert housing 20*a* and 20*b*. The air space 42 serves as a low dielectric layer, thereby reducing each capacitance induced between one of the tip conductors "T1" to "T4" and one of the ring conductors "R1" to "R4". For forming the air space 42, the upper and the lower insert housing 20*a* and 20*b* respectively have opposing concavities. After the upper and the lower insert housing 20*a* and 20*b* are joined together, the opposing concavities form the air space 42.

Figure 10B:
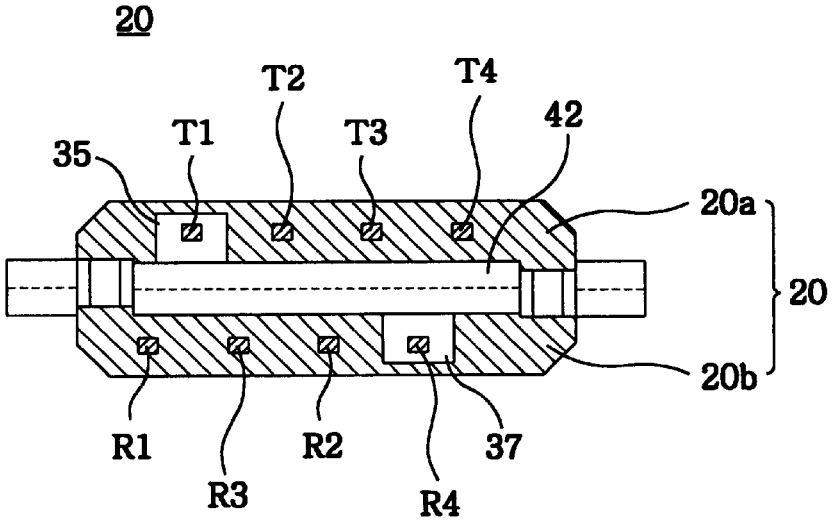

As shown in FIG. 10B, a first inner groove 35 and a second inner groove 37 may substitute for the upper and the lower opening portion 34 and 36 of FIG. 10A, respectively. Portions of the first tip conductor "T1" and the fourth ring conductor "R4" are also surrounded by air inside the upper and the lower insert housing 20*a* and 20*b*, but in this case, they are isolated from an outer circumstance.

If the upper insert housing 20*a* or the lower insert housing 20*b* is turned over, the upper and the lower insert housing 20*a* and 20*b* have same shapes. That is to say, the upper and the lower insert housing 20*a* and 20*b* are fabricated to have the same shapes but used as different parts, such that a fabrication cost thereof can be reduced.

The inner grooves 35 and 37, or the opening portions 34 and 36, and the air space 42 correlate with compensating portions 26 (FIGS. 11A and 11B), such that capacitances induced between adjacent conductors are selectively compensated so as to reduce the crosstalk. The compensating portions 26 and the above-mentioned selective compensation of the capacitances will be later explained in more detail.

Figure 12A:
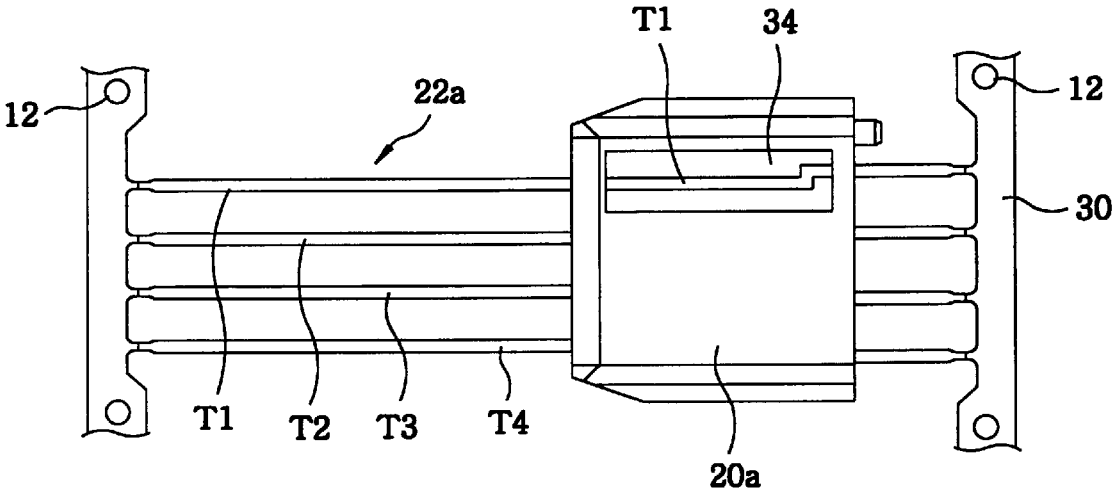
FIGS. 12A and 12B are plan views showing an upper insert housing assembled with tip conductors of FIG. 11A and a lower insert housing assembled with ring conductors of FIG. 11B, respectively.
Figure 12B:
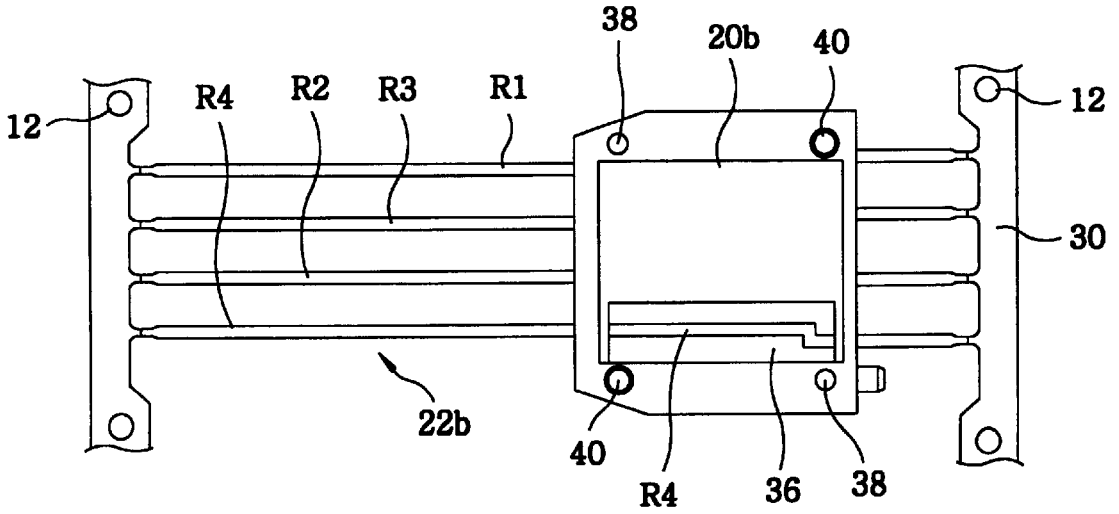
Figure 13:
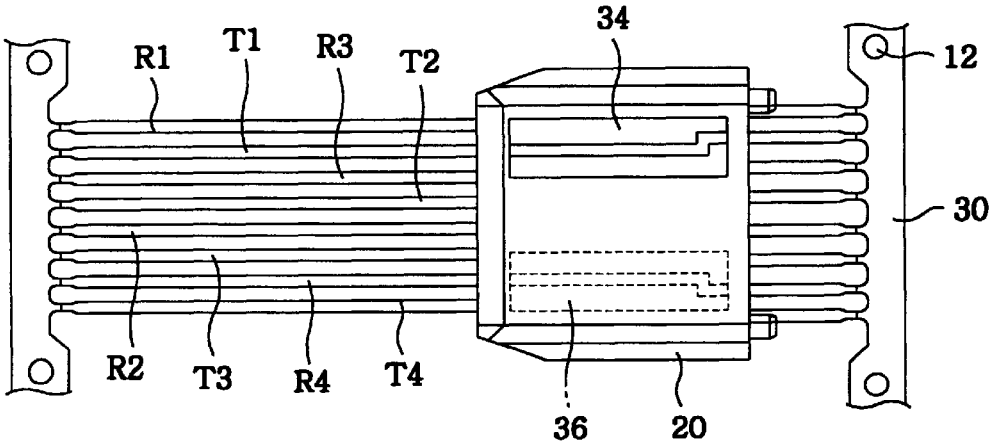
FIG. 13 is a plan view showing an assembly of the upper and the lower insert housing of FIGS. 12A and 12B.

Referring to FIGS. 11 to 13, a configuration of the insert 12 in accordance with the first preferred embodiment of the present invention will be described in connection with a fabrication process thereof.

Figure 11A:
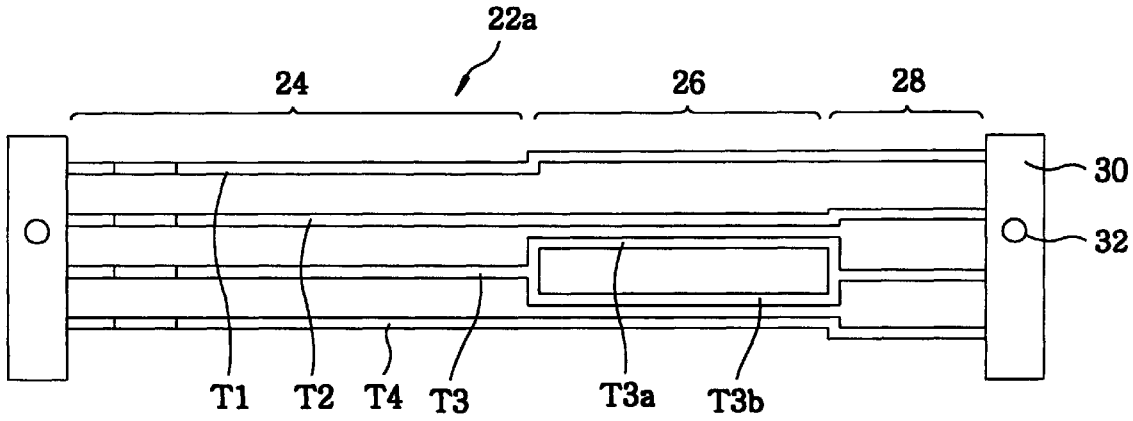
FIGS. 11A and 11B are plan views showing insert conductors in accordance with the first preferred embodiment of the present invention.
Figure 11B:
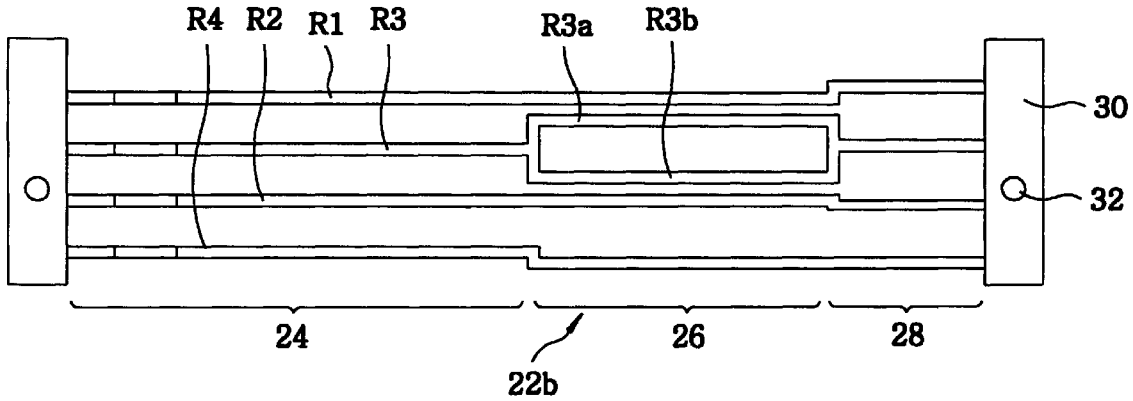

In FIGS. 11A and 11B, the first to the fourth tip conductors "T1" to "T4" are included in an upper set 22*a* while the first to the fourth ring conductors "R1" to "R4" are included in a lower set 22*b*. Each of the upper and the lower set 22*a* and 22*b* includes a spring portion 24, the compensating portion 26 and a PCB-connecting portion 28. After the plug 200 (FIG. 4) is inserted into the modular jack 10 (FIG. 4), each insert conductor electrically contacts a corresponding plug conductor 212 (FIG. 6) in the spring portion 24. In the PCB-connecting portion 28, each insert conductor is electrically connected with the PCB 240 (FIG. 4) by way of applying a soldering or the like.

Two holding portions 30, each having a carriage hole 32 passing therethrough, hold, respectively, a first and a second end of the upper and the lower set 22*a* and 22*b*. After the upper and the lower set 22*a* and 22*b* are assembled with the upper and the lower insert housing 20*a* and 20*b* (FIG. 9), respectively, the holding portions 30 are separated therefrom.

The first to the fourth tip conductors "T1" to "T4" correspond to the first to the fourth ring conductors "R1" to "R4", respectively, thereby forming independent signal pairs "T1–R1", "T2–R2", "T3–R3" and "T4"-R4". The third tip conductor "T3" has a first protrusion "T3*a*" and a second protrusion "T3*b*" positioned at the compensating portion 26. The third ring conductor "R3" has another first protrusion "R3*a*" and another second protrusion "R3*b*" positioned at the compensating portion 26. Each of the protrusions "T3*a*", "R3*a*", "T3*b*" and "R3*b*" serves to increase capacitances induced between adjacent conductors. Each compensating portion 26 is positioned inside the upper insert housing 20*a* of FIG. 14 or the lower insert housing 20*b* of FIG. 14.

If the upper set 22*a* or the lower set 22*b* is turned over, the upper and the lower set 22*a* and 22*b* have same shapes. That is to say, the upper and the lower set 22*a* and 22*b* are fabricated to have the same shapes but used as different parts, such that a fabrication cost thereof can be reduced.

In FIGS. 12A and 12B, the upper insert housing 20*a* and the lower insert housing 20*b* are formed by way of molding, wherein the compensating portions 26 of the upper and the lower set 22*a* and 22*b* are positioned inside the upper housing 20*a* and the lower housing 20*b*, respectively. The upper and the lower insert housing 20*a* and 20*b* are preferably made of "PBT+GF 0~30%" (polyethylene terephthalate+glass fiber). At this point, a dielectric constant of the upper and the lower insert housing 20*a* and 20*b* is preferably about 3.6 to 4.0.

Each of the upper and the lower insert housing 20*a* and 20*b* has males and females 38 and 40, which are formed on each opposing surface of the upper and the lower insert housing 20*a* and 20*b*. The males 38 are forced into the females 40, such that the upper and the lower insert housing 20*a* and 20*b* can be joined together. As shown in FIG. 13, after the upper and the lower housing 20*a* and 20*b* are joined together, the ring conductors "R1" to "R4" and the tip conductors "T1" to "T4" are alternately arranged at outside of the insert housing 20.

As previously mentioned, the opening portions 34 and 36, or the inner grooves 35 and 37 (FIG. 10B), and the air space 42 (FIGS. 10A and 10B) correlate with compensating portions 26, such that capacitances induced between adjacent conductors are selectively compensated so as to reduce the crosstalk.

Figure 14:
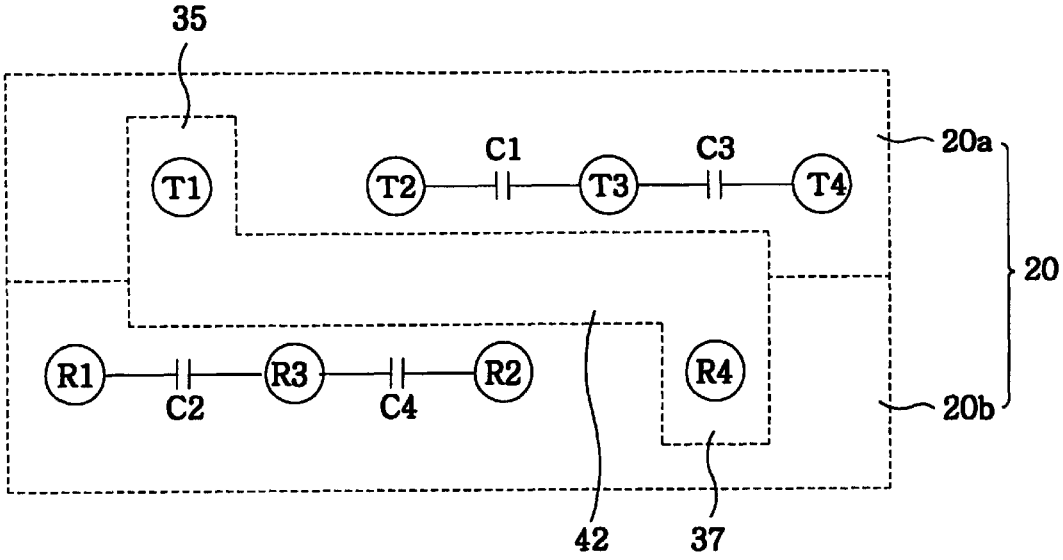
FIG. 14 is a cross-sectional view illustrating a double level arrangement of the insert conductors shown in FIGS. 11A and 11B.

Referring to FIG. 14, the selective compensation for the capacitances induced inside the insert housing 20 will be explained in more detail.

The tip conductors "T1" to "T4" are arranged on the upper level while the ring conductors "R1" to "R4" are arranged on the lower level, thereby forming the double level arrangement. For the sake of convenience, the protrusions "T3*a*", "R3*a*", "T3*b*" and "R3*b*" (FIGS. 11A and 11B) are not illustrated, and an interval interposed between adjacent conductors is assumed constant.

When signals are respectively applied to the conductors, capacitances are induced between adjacent conductors. For example, a first capacitance "C1" is induced between the second tip conductor "T2" and the first protrusion "T3*a*" (FIG. 11A) of the third tip conductor "T3". A second capacitance "C2" is induced between the first ring conductor "R1" and the first protrusion "R3*a*" (FIG. 11B) of the third ring conductor "R3". A third capacitance "C3" is induced between the fourth tip conductor "T4" and the second protrusion "T3*b*" (FIG. 11A) of the third tip conductor "T3". In addition, a fourth capacitance "C4" is induced between the second ring conductor "R2" and the second protrusion "R3*b*" (FIG. 11B) of the third ring conductor "R3".

Because of the first and the second protrusions "R3*a*", "R3*b*", "T3*a*" and "T3*b*" (FIGS. 11A and 11B), each of the first to the fourth capacitances "C1" to "C4" has a relatively larger value. On the contrary, because of the first and the second inner groove 35 and 37 or the opening portions 34 and 36 of FIG. 13A, a relatively smaller capacitance is induced between the first tip conductor "T1" or the fourth ring conductor "R1" and an adjacent conductor thereof. Further, because of the air space 42 and the double level arrangement, each capacitance induced between one of the tip conductors and one of the ring conductors is much smaller than each of the first to the fourth capacitances "C1" to "C4".

The above-described first preferred embodiment of the present invention adopts the double level arrangement so as to focus on reducing the capacitive coupling. However, because the inductive coupling is also present in an electrical connector, a second preferred embodiment of the present invention adopts a multi-level arrangement, thereby reducing both of the capacitive coupling and the inductive coupling.

Referring now to FIGS. 15 to 22, an insert 112 in accordance with the second preferred embodiment of the present invention will be described in detail.

Figure 15A:
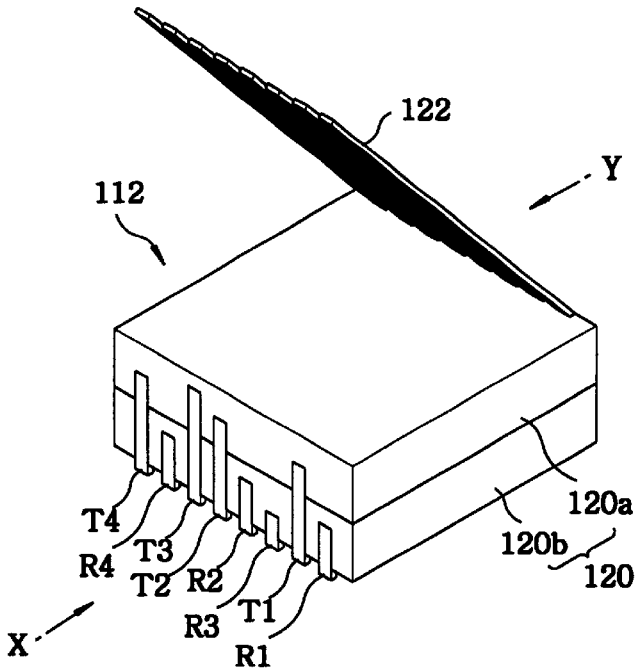
FIGS. 15A and 15B are perspective views illustrating an insert in accordance with a second preferred embodiment of the present invention.
Figure 15B:
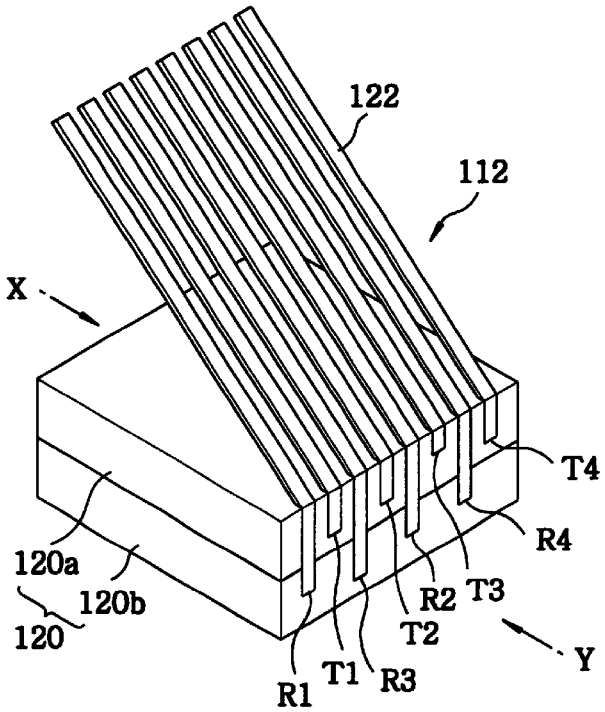

In FIGS. 15A and 15B, the insert 112 in accordance with the second preferred embodiment includes an insert housing 120 and a plurality of insert conductors 122, including first to fourth tip conductors "T1" to "T4" and first to fourth ring conductors "R1" to "R4". The insert housing 120 has an upper insert housing 120*a* and a lower insert housing 120*b*. The upper insert housing 120*a* is assembled with the first to the fourth tip conductors "T1" to "T4" and maintains relative positions thereof. Whereas, the lower insert housing 120*b* is assembled with the first to the fourth ring conductors "R1" to "R4" and maintains relative positions thereof. In the drawings, a first direction "Y" directs a front surface of the insert housing 120 while a second direction "X" directs a rear surface thereof. In other words, the front surface is indicated by a reference letter "Y" while the rear surface is indicated by a reference letter "X".

Figure 16:
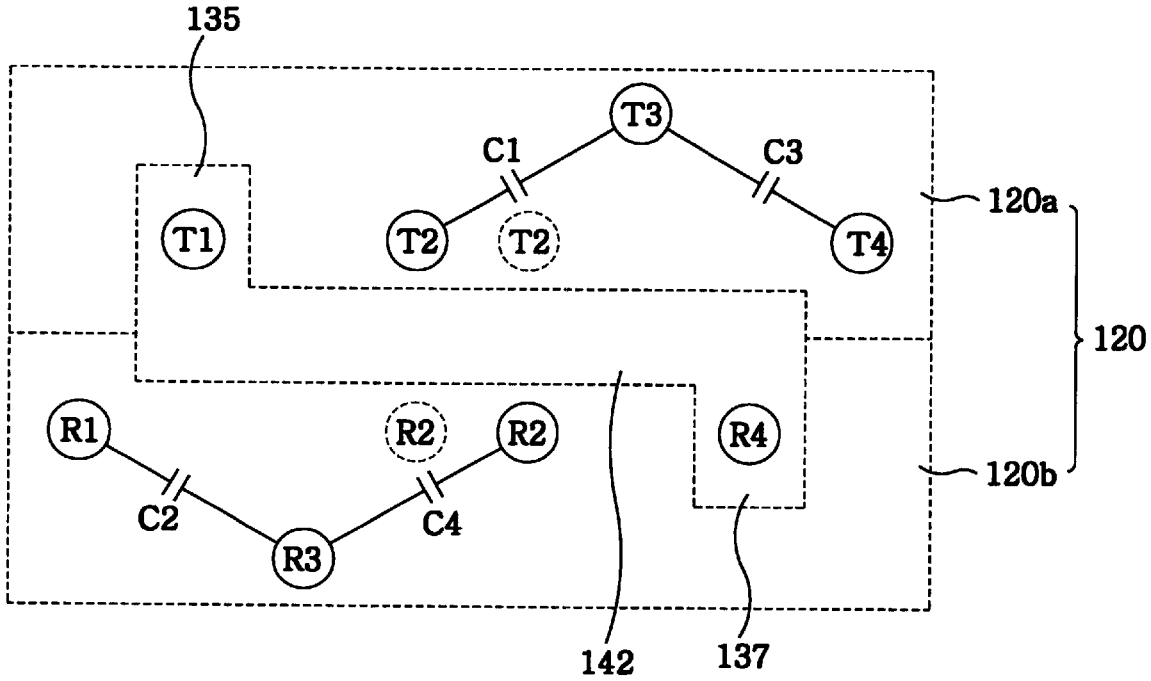
FIG. 16 is a cross-sectional view illustrating a multi-level arrangement of insert conductors of FIGS. 15A and 15B.

FIG. 16 illustrates a cross-section of FIG. 15B. As shown, the insert housing 120 further includes an air space 142 inside. The air space 142 is formed between the upper and the lower insert housing 120*a* and 120*b* and has the same shape and effect as those of the air space 42 (FIGS. 10A and 10B) of the first preferred embodiment. The upper and the lower insert housing 120*a* and 120*b*, respectively, have a first and a second inner groove 135 and 137, which have the same shape and effect as those of the first and the second inner groove 35 and 37 (FIG. 10B) of the first preferred embodiment, respectively. Alternatively, the first and second inner groove 135 and 137 may be substituted with an upper and a lower opening portion (not shown), respectively. The upper and the lower opening portion (not shown) of the second preferred embodiment have the same shapes and effects as those of the upper and the lower opening portion 34 and 36 (FIG. 10A) of the first preferred embodiment.

Returning to FIGS. 15A and 15B, each of the insert conductors 122 passes through the insert housing 120 and bends at the front and the rear surface "Y" and "X" of the insert housing 120. Inside the insert housing 120, at least two insert conductors are arranged on different levels.

Figure 17:
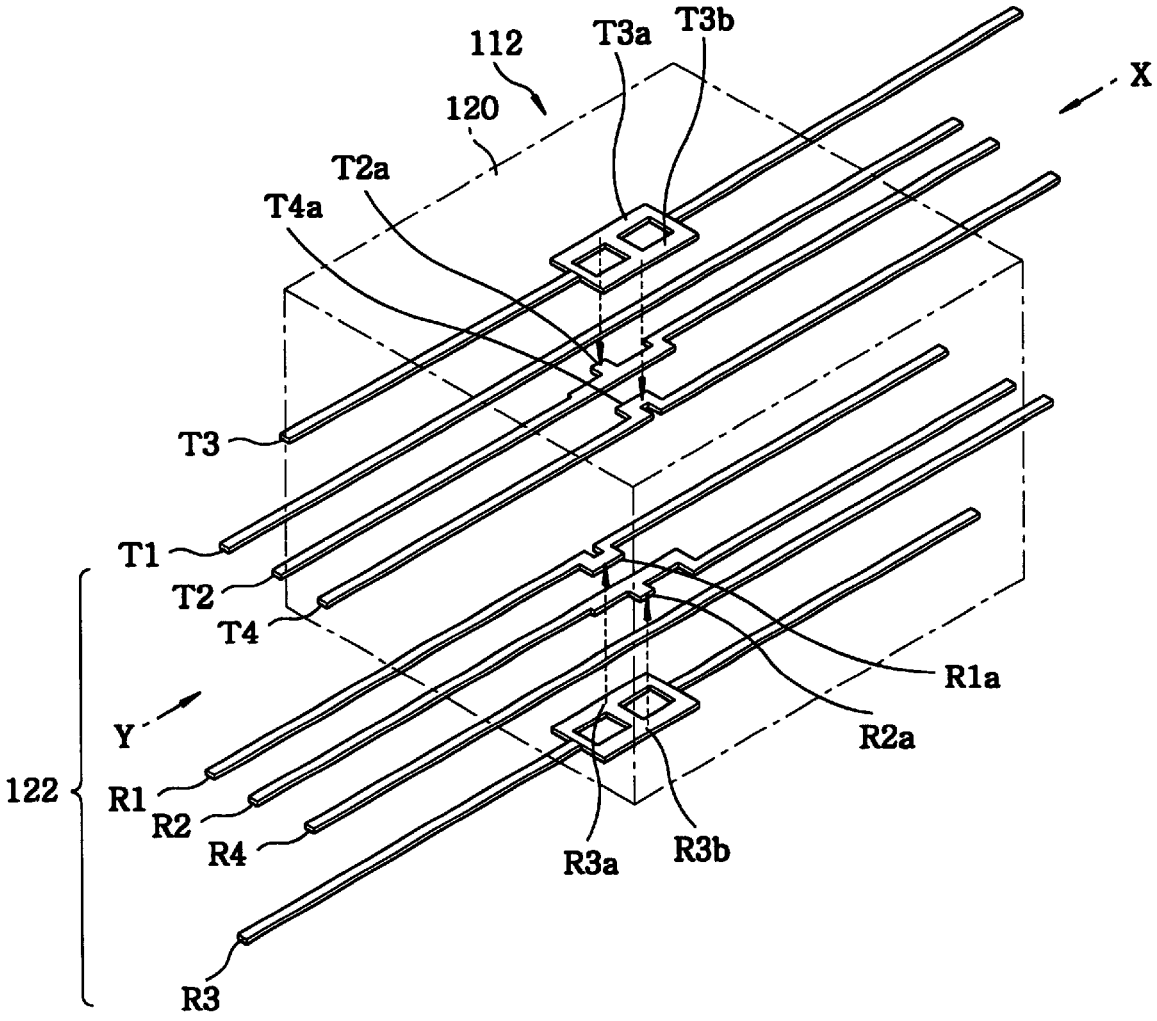
FIG. 17 is a disassembled perspective view illustrating the insert conductors of FIGS. 15A and 15B.

Referring to FIG. 17 as well as FIG. 16, a configuration of the insert 112 will be explained.

The third tip conductor "T3" is on a first level, which is a top level. The other tip conductors "T1", "T2" and "T4" are on a second level, which is below the first level. The first, second and fourth ring conductors "R1", "R2" and "R4" are on a third level, which is below the second level. Further, the third ring conductor "R3" is on a fourth level, which is a bottom level.

The third tip conductor "T3" has a first protrusion "T3*a*" and a second protrusion "T3*b*" while the third ring conductor "R3" has another first protrusion "R3*a*" and another second protrusion "R3*b*". The second and the fourth tip conductor "T2" and "T4" have a third and a fourth protrusion "T2*a*" and "T4*a*", respectively. In addition, the first and the second ring conductor "R1" and "R2" have another third and another fourth protrusion "R1*a*" and "R2*a*", respectively. The third protrusions "T2*a*" and "R1*a*" preferably correspond to centers of the first protrusions "T3*a*" and "R3*a*", respectively. The fourth protrusions "T4*a*" and "R2*a*" preferably correspond to centers of the second protrusions "T3*b*" and "R3*b*", respectively.

In addition, each of the second tip conductor "T2" and the second ring conductor "R2" is bent at least one time, such that the second tip and the second ring conductor "T2" and "R2" cross each other and exchange their positions. Consequently, if the second ring conductor "R2" and the second tip conductor "T2" are sequentially arranged in that order at the front surface "Y" of the insert housing 120, the second tip conductor "T2" and the second ring conductor "R2" are sequentially arranged in that order at the rear surface "X" thereof.

Before a more detailed explanation is given about the multi-level arrangement of the insert conductors 122 in accordance with the second preferred embodiment, the inductive coupling will be explained in detail.

Figure 18:
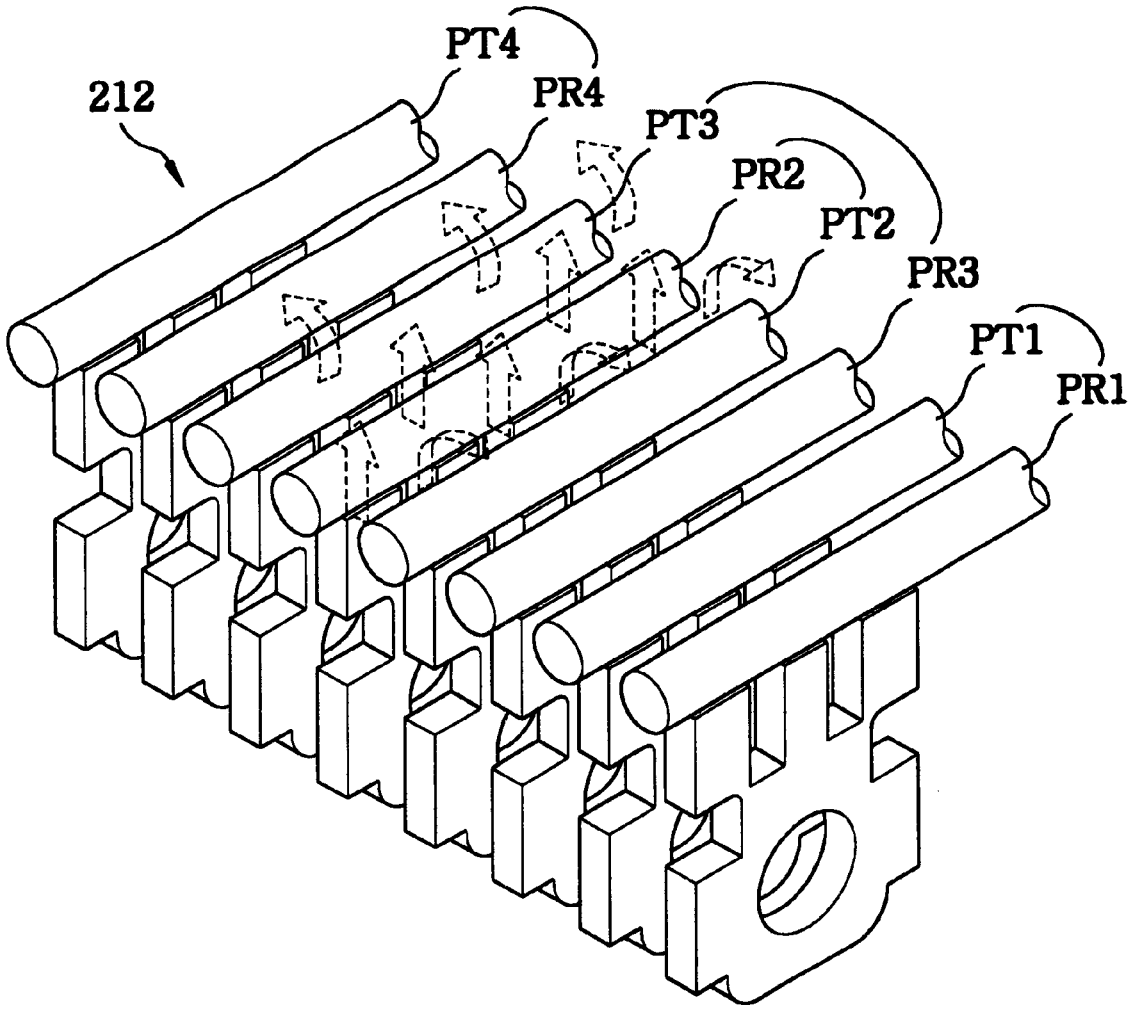
FIG. 18 is a perspective view illustrating a magnetic field produced from the plug conductors of FIG. 7.

FIG. 18 illustrates a magnetic field induced in the plug conductors 212 that are previously explained with reference to FIG. 7. If the third signal is applied to the third signal pair "PT3–PR3", the magnetic field is induced along the sixth and the third plug conductor "PT3" and "PR3". The magnetic field affects the second signal pair "PT2–PR2", thereby forming the inductive coupling between the second signal pair "PT2–PR2" and the third signal pair "PT3–PR3".

Figure 19:
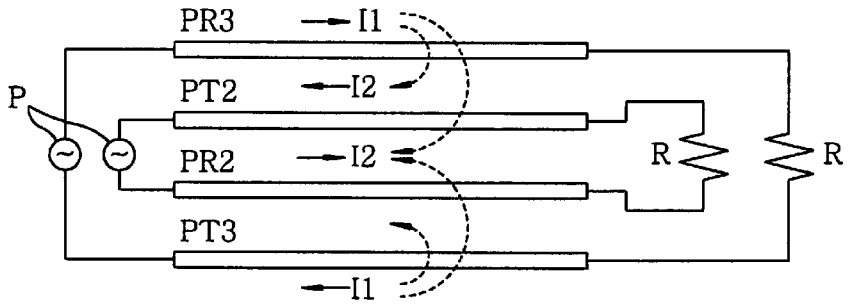
FIG. 19 is a circuit diagram illustrating an inductive coupling induced between adjacent signal pairs of the plug conductors shown in FIG. 18.

A more detailed explanation about the inductive coupling will be provided with reference to FIG. 19.

The sixth plug conductor "PT3" and the third plug conductor "PR3" form a first closed circuit with a termination resistance R and a signal source P. The fourth plug conductor "PT2" and the fifth plug conductor "PR2" form a second closed circuit with another termination resistance R and another signal source P. If a first current "I1" is applied to the first closed circuit, a magnetic field is induced along the sixth plug conductor "PT3" and the third plug conductor "PR3". The magnetic field exerts an electromagnetic effect on a second current "I2" applied to the fourth and the fifth plug conductor "PT2" and "PR2" of the second closed circuit, thereby jamming the second current "I2". That is to say, the inductive coupling is induced between the first and the second current "I1" and "I2" that are respectively transmitted along the adjacent plug conductors.

Figure 20:
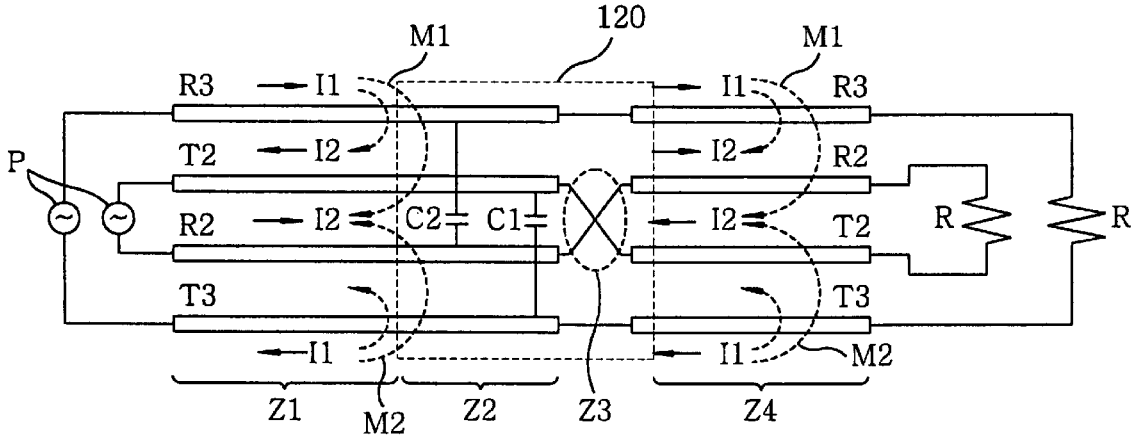
FIG. 20 is a circuit diagram illustrating a crosstalk-canceling system in accordance with the second preferred embodiment of the present invention.

Referring to FIG. 20, a system for sequentially reducing the capacitive coupling and the inductive coupling will be explained.

As shown, the third tip conductor "T3" and the third ring conductor "R3" form another first closed circuit with another termination resistance R and signal source P. The second tip conductor "T2" and the second ring conductor "R2" form another second closed circuit with a termination resistance R and a signal source P. Each closed circuit, or each insert conductor has first to fourth portions "Z1" to "Z4", and the second and the third portions "Z2" and "Z3" are positioned inside the insert housing 120. The insert conductors 122 (FIG. 15A) are electrically connected with the plug conductors 212 (FIG. 18) at the first portion "Z1". On the other hand, the insert conductors 122 (FIG. 15A) are electrically connected with the PCB 250 (FIG. 5) at the fourth portion "Z4".

A first current "I1" is applied to the first closed circuit at the first portion "Z1" while a second current "I2" is applied to the second tip conductor "T2" of the second closed circuit. Capacitances are induced between adjacent insert conductors because of the first and the second current "IT" and "T2". The capacitances between the adjacent insert conductors are selectively compensated at the second portion "Z2". A first capacitance "C1" and a second capacitance "C2" are results of the selective compensation, which is explained in detail in the first preferred embodiment.

The second tip conductor "T2" and the second ring conductor "R2" cross each other at the third portion "Z3", such that positions thereof are exchanged at the fourth portions "Z4". The first current "I1" of the third ring conductor "R3" causes a first magnetic field "M1" while the first current "I1" of the third tip conductor "T3" causes a second magnetic field "M2". The first and the second magnetic field "M1" and "M2" have opposite directions. The first magnetic field "M1" electromagnetically affects the second current "I2" at the first portion "Z1", thereby forming a first inductive coupling between the first and the second current "I1" and "I2". Then, because of the position exchange at the third portion "Z3", the second magnetic field "M2" electromagnetically affects the second current "I2" at the fourth portion "Z4", thereby forming a second inductive coupling between the first and the second current "I1" and "I2". At this point, because the first and the second magnetic field "M1" and "M2" have opposite directions, the first and the second inductive coupling also have opposite phases, thereby canceling each other.

Because the first portion "Z1" usually has a greater length than the second portion "Z1" has, a sum of the first inductive coupling is also larger than that of the second inductive coupling. Therefore, it is preferred that the second inductive coupling induced at the fourth portion "Z4" is maximized.

A third inductive coupling is further induced at the second portion "Z2". Because the third inductive coupling has a same phase as the first inductive coupling has, it has an effect of increasing the first inductive coupling. Therefore, unless the third inductive coupling induced at the second portion "Z2" is minimized, the fourth portion "Z4" should have a greater length than the first portion "Z1" has. To prevent the problem, it is preferred that the third inductive coupling induced at the second portion "Z2" is minimized.

Figure 21A:
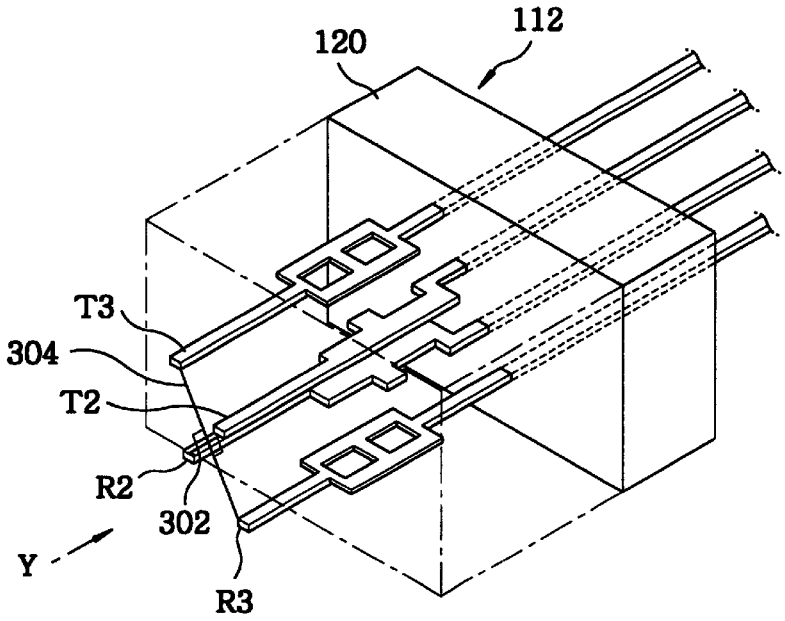
FIGS. 21A and 21B are expanded perspective views illustrating the multi-level arrangement of the insert conductors shown in FIG. 17.
Figure 21B:
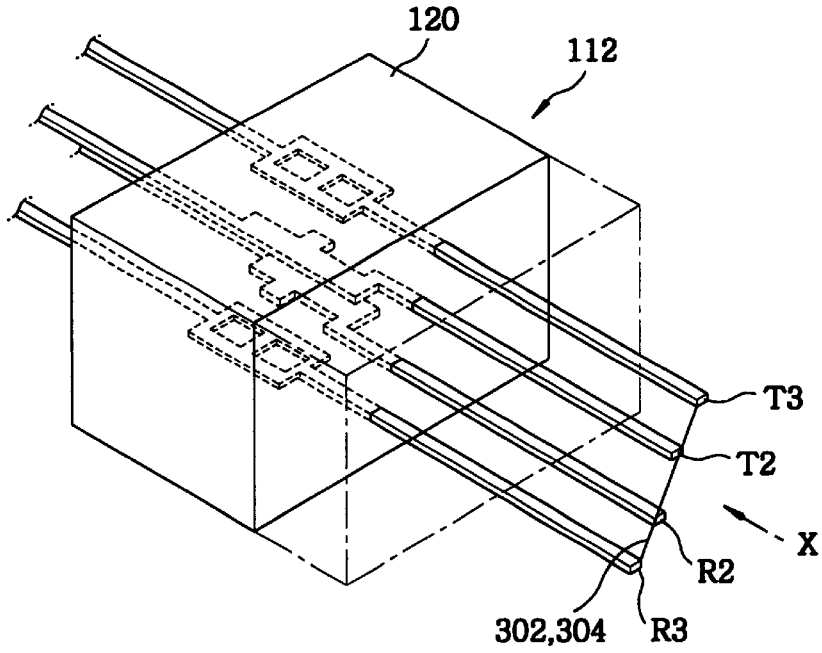

With reference to FIGS. 21A and 21B, the above-mentioned minimization and maximization of the inductive coupling is explained in more detail. FIGS. 21A and 21B show a first and a second multi-level arrangement of the insert conductors, respectively.

The second tip and the second ring conductor "T2" and "R2" form the first closed circuit on a first imaginary plane 302 while the third tip and the third ring conductor "T3" and "R3" form the second closed circuit on a second imaginary plane 304. The front surface "Y" of the insert housing 120 serves as a boundary that divides the first and the second portion "Z1" and "Z2" of FIG. 20. The rear surface "X" thereof serves as another boundary that divides the third and the fourth portion "Z3" and "Z4" of FIG. 20.

Inside the front surface "Y", the first and the second imaginary plane 302 and 304 are perpendicular to each other so as to minimize the third inductive coupling. On the contrary, inside the rear surface "X", the first and the second imaginary plane 302 and 304 correspond to each other so as to maximize the second inductive coupling. Preferably, the first and the second imaginary plane 302 and 304 make a first angle of about 80 to 90 degrees at the second portion "Z2" of FIG. 20 and a second angle of about 0 to 10 degrees at the fourth portion "Z4" of FIG. 20.

Figure 22:
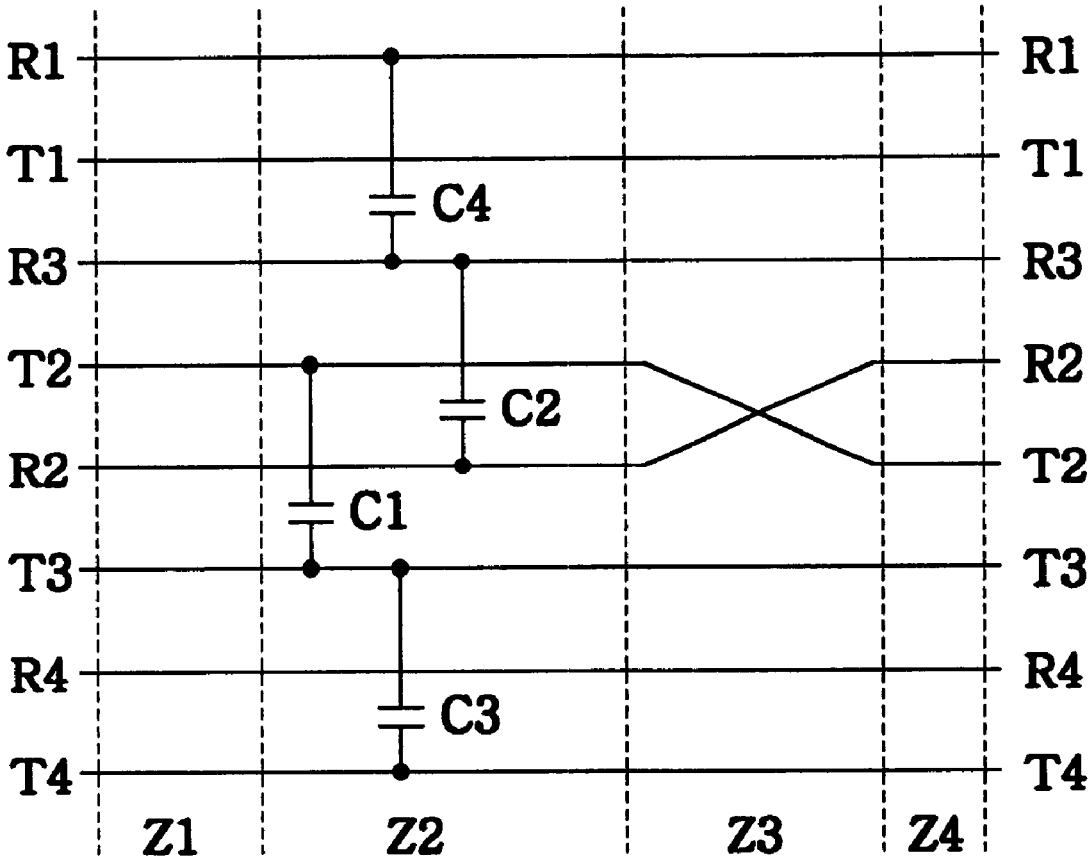
FIG. 22 illustrates an equivalent circuit that corresponds to the insert of FIGS. 15A and 15B.

An equivalent circuit for the insert 112 (FIG. 15A) in accordance with the second preferred embodiment is illustrated in FIG. 22. The first ring and the first tip conductor "R1" and "T1" form a first independent signal pair; the second ring and the second tip conductor "R2" and "T2" form a second independent signal pair; the third ring and the third tip conductor "R3" and "T3" form a third independent signal pair; and the fourth ring and the fourth tip conductor "R4" and "T4" form a fourth independent signal pair.

The first to the fourth capacitances "C1" to "C4" formed at the second portion "Z2" have a relatively larger value, such that the capacitances induced between the adjacent insert conductors can be selectively compensated. Many other capacitances except for the first to the fourth capacitances "C1" to "C4" are also induced at the second portion "Z2". The other capacitances, however, are much smaller than the first to the fourth capacitances "C1" to "C4" and are not illustrated for the sake of convenience.

The second tip conductor "T2" and the second ring conductor "R2" cross each other at the third portion "Z3". Therefore, the second tip conductor "T2" and the second ring conductor "R3" exchange their positions at the fourth portion "Z4".

If first to fourth signals are respectively applied to the first to the fourth independent signal pairs, a capacitive coupling and an inductive coupling are induced between adjacent signal pairs. For example, the first capacitive and the first inductive coupling are induced at the first portion "Z1", and the second capacitive and the second inductive coupling are induced at the fourth portion "Z4". The first and the second capacitive coupling are reduced by the selective compensation at the second portion "Z2". Further, the first and the second inductive coupling cancel each other because of the position exchanges at the fourth portion "Z4".

The third inductive coupling is further induced at the second portion "Z2", and a first multi-level arrangement shown in FIG. 21A minimizes the third inductive coupling. On the contrary, the second inductive coupling is maximized because of a second multi-level arrangement shown in FIG. 21B. That is to say, the first and the second multi-level arrangement provide an optimum condition for the mutual canceling of the first and the second inductive coupling.

While the invention has been shown and described with respect to the preferred embodiments, it will be understood by those skilled in the art that various changes and modifications may be made without departing from the spirit and scope of the invention as defined in the following claims.

What is claimed is:

1. A modular jack for a low crosstalk electrical connector, the jack comprising:

a housing;

a first signal pair passing through the housing and including a first conductor and a second conductor, a first imaginary plane containing the first and the second conductor; and a second signal pair passing through the housing and including a third conductor and a fourth conductor, a second imaginary plane containing the third and the fourth conductor, which are bent at least one time to cross each other inside the housing, wherein the first and the second imaginary plane form a first angle of 80 to 90 degrees inside the housing before the crossing of the third and the fourth conductor while the first and the second imaginary plane form a second angle of 0 to 10 degrees inside the housing after the crossing thereof.

2. The jack of claim 1, wherein the first conductor is arranged on a first level, the third conductor is arranged on a second level below the first level, the second conductor is arranged on a third level below the second level, and the fourth conductor is arranged on a fourth level below the third level.

3. The jack of claim 2, further comprising a third signal pair including a fifth conductor and a sixth conductor, and a fourth signal pair including a seventh conductor and an eighth conductor, wherein the fifth and seventh conductor are arranged on the second level while the sixth and eighth conductor are arranged on the third level.

4. The jack of claim 3, wherein at least one of the first to the eighth conductors includes a protrusion to increase at least one capacitance induced between adjacent conductors.

5. The jack of claim 3, wherein the housing includes at least one air space therein and the air space is positioned between at least two adjacent conductors.

6. The jack of claim 3, wherein the housing includes at least one opening portion to expose a portion of at least one conductor.

7. The jack of claim 3, wherein the housing includes at least one inner groove therein and the inner groove surrounds a portion of at least one conductor.

8. The jack of claim 1, wherein the housing is made of a dielectric material having a dielectric constant of about 3.6 to 4.0.

9. The jack of claim 8, wherein the dielectric material is "PBT+GF 0~30%" (polyethylene terephthalate+glass fiber).

10. An insert of a crosstalk reducing modular jack, the insert comprising:

an upper housing;

a lower housing joined with the upper housing, the upper and the lower housing being symmetrical to each other with respect to a contact surface therebetween;

an upper set including first to fourth tip conductors passing through the upper housing and being arranged on a plurality of levels, the third tip conductor having a first and a second protrusion protruded toward the second and the fourth tip conductor, respectively;

a lower set positioned under the upper set, the lower set including first to fourth ring conductors passing through the lower housing and being arranged on a plurality of another levels, the second ring conductor having another first and another second protrusion protruded toward the first and third ring conductors, respectively;

a first air space interposed between the upper and the lower set;

a second air space surrounding a portion of the first tip conductor inside the upper housing; and a third air space surrounding a portion of the fourth ring conductor inside the lower housing.

11. The insert of claim 10, wherein the third tip conductor is arranged on a first level, the first, the second and the fourth tip conductor are arranged on a second level below the first level, the first, the third and the fourth ring conductor are arranged on a third level below the second level, and the second ring conductor is arranged on a fourth level below the third level.

12. The insert of claim 10, wherein the second tip conductor and the third ring conductor cross each other inside the housing, a first imaginary plane containing the second tip conductor and third ring conductor, a second imaginary plane containing the third tip conductor and the second ring conductor, the first and the second imaginary plane forming a first angle of 80 to 90 degrees before the crossing and a second angle of 0 to 10 degrees after the crossing.

13. The insert of claim 10, wherein the upper and the lower housing are made of a dielectric material having a dielectric constant of about 3.6 to 4.0.

14. The insert of claim 13, wherein the dielectric material is "PBT+GF 0~30%" (polyethylene terephthalate+glass fiber).

* * * * *